US005857408A

United States Patent [19]

Witter

[11] Patent Number: 5,857,408

[45] Date of Patent: Jan. 12, 1999

[54] MANUAL REFUSE COMPACTOR

[76] Inventor: Lowell F. Witter, 450 S. Belmont, Elgin, Ill. 60123

[21] Appl. No.: 965,572

[22] Filed: Nov. 6, 1997

Related U.S. Application Data

[63] Continuation-in-part of Ser. No. 744,375, Nov. 7, 1996.

[51] Int. Cl.[6] ..... B30B 15/06

[52] U.S. Cl. ..... 100/265; D7/682; D8/14; D15/123; 100/295; 404/133.1

[58] Field of Search ..... 100/226, 265, 100/295, 299; 68/122, 215–219; 4/255.01, 255.11, 255.12; 241/168, 169.2; 404/133.1; D7/682; D8/14; D15/123; D32/35

[56] References Cited

U.S. PATENT DOCUMENTS

| | | | |
|---|---|---|---|
| D. 46,997 | 2/1915 | Howell | 4/255.11 |
| 193,480 | 7/1877 | Cady et al. | 68/122 |
| 205,500 | 7/1878 | Patterson . | |
| D. 206,926 | 2/1967 | Lurski . | |
| 215,588 | 5/1879 | Dolman . | |
| D. 256,770 | 9/1980 | Broyles . | |
| 330,296 | 11/1885 | Critchfield | 68/215 |
| 378,711 | 2/1888 | Nelson . | |
| 498,118 | 5/1893 | Hopkins . | |
| 597,333 | 1/1898 | Snow | 68/215 |
| 741,409 | 10/1903 | Oines . | |
| 1,005,950 | 10/1911 | Forkner | 68/218 |
| 1,069,750 | 8/1913 | Williams et al. . | |
| 1,852,071 | 4/1932 | Becker . | |
| 1,874,048 | 8/1932 | Kelley . | |
| 1,960,902 | 5/1934 | Freyn . | |
| 2,203,185 | 6/1940 | Walus . | |
| 2,579,671 | 12/1951 | Holl . | |
| 3,438,322 | 4/1969 | Marasco . | |
| 3,565,351 | 2/1971 | Ross, Jr. . | |
| 3,760,718 | 9/1973 | Adornetto . | |
| 3,779,157 | 12/1973 | Ross, Jr. et al. . | |
| 3,850,094 | 11/1974 | Shontz . | |
| 4,158,995 | 6/1979 | Kaplan et al. . | |
| 4,395,792 | 8/1983 | Cosner . | |
| 4,622,702 | 11/1986 | Allen . | |
| 4,629,233 | 12/1986 | Pfisterer . | |
| 4,682,539 | 7/1987 | Bramblett et al. . | |
| 4,991,500 | 2/1991 | Knapp . | |
| 5,062,329 | 11/1991 | Connolly et al. . | |
| 5,090,309 | 2/1992 | Lai . | |
| 5,090,756 | 2/1992 | Pfisterer . | |

FOREIGN PATENT DOCUMENTS

| | | |
|---|---|---|
| 91452 | 2/1923 | Austria . |
| 11564 | of 1887 | United Kingdom . |

*Primary Examiner*—Stephen F. Gerrity
*Attorney, Agent, or Firm*—Craig A. Summerfield; Brinks Hofer Gilson & Lione

[57] ABSTRACT

A compactor is provided and comprises a body having a connector side and a compacting side. A lip extends from the compacting side. The lip forms and at least partially surrounds a cavity on the compacting side. Finally, a connector is provided on the connector side. A handle connects to the connector, and the cavity has a v-shape surface structure. The user grasps the handle and repeatedly lowers the compactor to compact the debris.

12 Claims, 5 Drawing Sheets

MANUAL REFUSE COMPACTOR

CROSS-REFERENCE TO RELATED APPLICATION

This application is a continuation-in-part of co-pending U.S. patent application Ser. No. 08/744,375, filed Nov. 7, 1996 (pending).

FIELD OF THE INVENTION

The present invention relates generally to compactors. More particularly, the invention relates to a hand-held compactor for compacting leaves, household waste or other refuse.

BACKGROUND OF THE INVENTION

Household and yard waste is typically placed in various types of containers. Metal and plastic containers are often used for various waste. Further, plastic and paper bags are also used. Local waste services typically charge, in part, by the number of containers that must be emptied or removed.

As more communities offer or require yard waste recycling, the potential for added disposal costs increases. Compacting the waste may reduce the number of containers and cost of removal, particularly for yard waste. For example, leaves may be easily compacted.

Others have created devices for compacting leaves. For example, U.S. Pat. Nos. 4,629,233 and 5,090,756 to Dieter E. Pfisterer disclose devices for compacting material such as leaves, grass and trash. These devices include a specialized flat faced rake and funnel combination. Leaves or other refuse is pushed with the rake into the funnel. The funnel directs the refuse into a container for disposal. However, these devices require storage of the funnel, and the specialized rakes may not adequately break-up and compact the waste.

Devices for compacting household or restaurant waste, instead of leaves, have also been developed. For example, U.S. Pat. No. 4,158,995 to Kaplan et al. discloses a device for compacting waste. A handle is attached to a metal compacting head. The compacting head has a flat, open framework. However, waste may get caught in or on top of the open framework, and the metal construction may result in added manufacturing costs.

Therefore, there is a need for an apparatus that is compact for storage and acts to break-up and compact waste, whether yard or household waste, without getting waste lodged in the compactor.

SUMMARY OF THE INVENTION

The present invention provides a manual refuse compactor for breaking up and compacting waste. In one aspect of the invention, the compactor includes a body with a connector side and a compacting side. A lip extends from the compacting side and forms, and at least partially surrounds, a cavity on the compacting side. The compacting side includes a crown. A connector is provided on the connector side . The body and lip have substantially the same uniform thickness.

In a second aspect of the invention, a body of a compactor includes a top side, a circumference side and a compacting side. The top side includes a first half and a second half with each half sloped downwards towards a connector.

In a third aspect of the invention, the body of a compactor includes: a bottom surface with a center region and a circumference region, a plurality of fins extending from the center region to the circumference region, and a lip extending from the circumference region. The bottom surface, fins and lip define a plurality of downward opening cavities. A handle connects to the top surface of the body.

In a fourth aspect of the invention, a body of a compactor includes a plurality of gradually curved fins radiating from a center region to a circumference region. Each of the plurality of fins curves in the same direction. A lip extends from the circumference region, and a handle connects on a top surface of the body.

It is to be understood that both the foregoing general description and the following detailed description are exemplary and are intended to provide further explanation of the invention as claimed. The invention, together with further objects and attendant advantages, are best understood by reference to the following detailed description in conjunction with the attached drawings.

DETAILED DESCRIPTION OF THE PRESENTLY PREFERRED EMBODIMENTS

Figure 1:
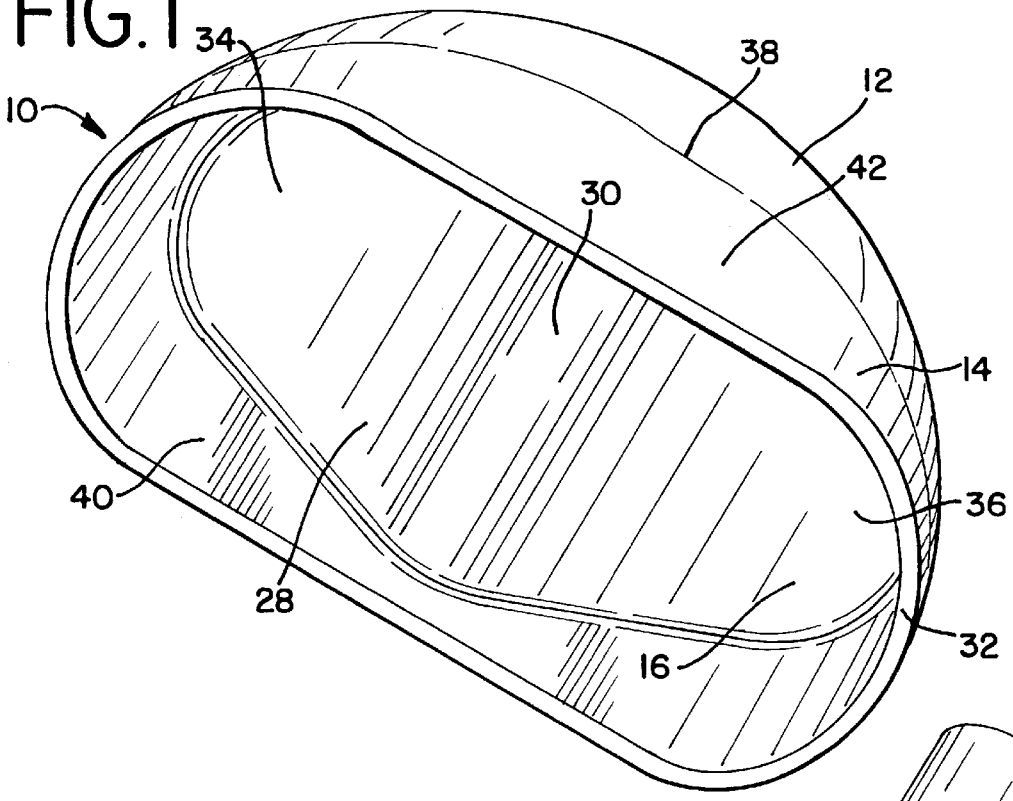
FIG. 1 is a perspective view of a manual refuse compactor.
Figure 3:
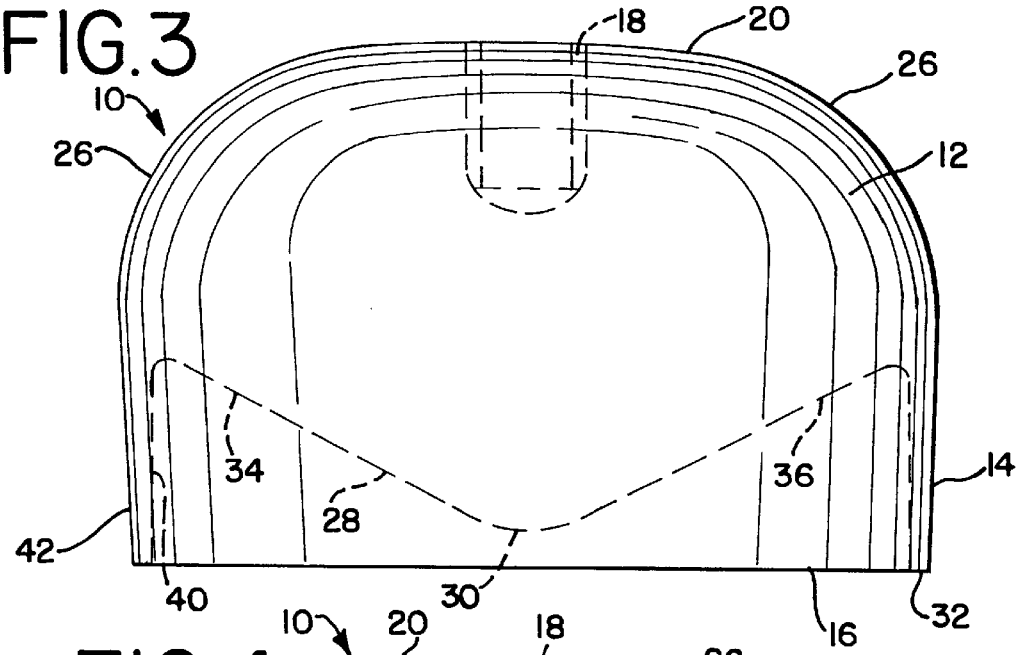
FIG. 3 is a cross sectional front side view of the manual refuse compactor of FIG. 1.
Figure 4:
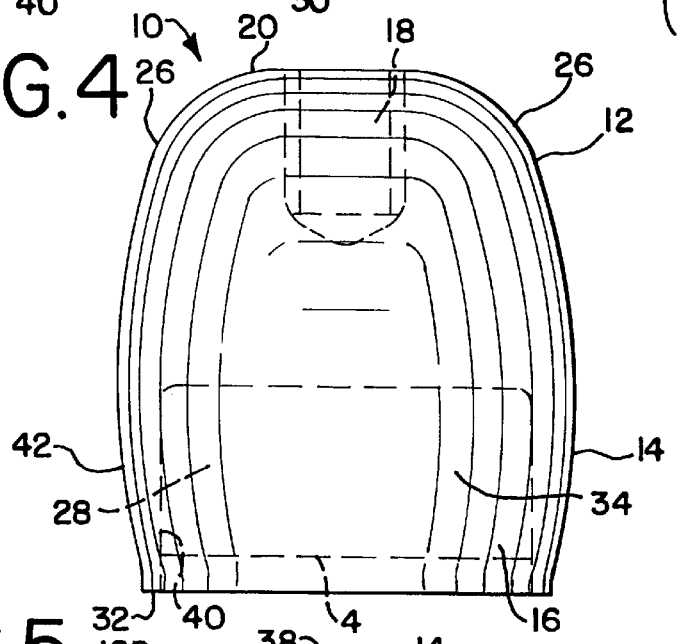
FIG. 4 is a side view of the manual refuse compactor of FIG. 1.

Referring now to the drawings and more particularly to FIGS. 1, 3 and 4, the manual refuse compactor is generally shown at 10. The compactor 10 includes a body 12, a lip 14 and an cavity 16. Preferably, the lip 14 extends from the body 12 to create the cavity 16. Compactor 10 is preferably about seven (7) inches long, four (4) inches wide and five (5) inches tall. However, compactor 10 may be of various sizes.

The lip 14 and body 12 may comprise a singular piece of material. Preferably, the lip 14 and body 12 are made from injection molded plastic. Alternatively, suitable metals, such as aluminum, may be milled, lathed and tapped to form lip 14 and body 12. Preferably, the body 12 is rigid. The body 12 is solid. The solid structure of body 12 adds weight to the compactor 10 for better compacting. Alternatively, weights or voids could be added to the body 12 to create a desired weight for compactor 10.

Figure 6:
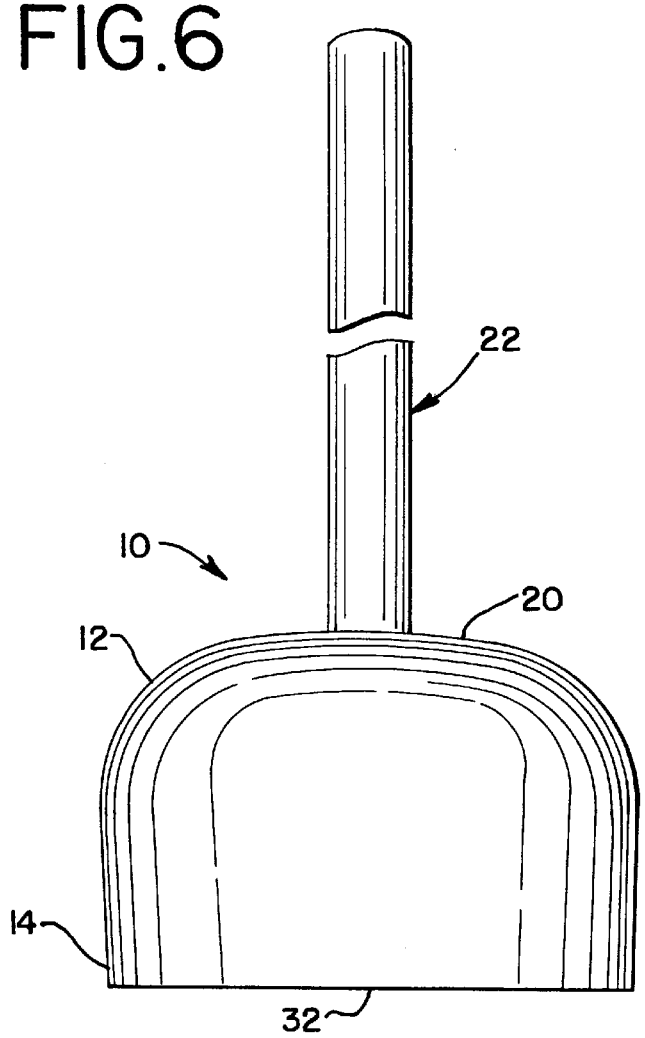
FIG. 6 is a front side view of the manual refuse compactor of FIG. 1 with a handle attached.
Figure 7:
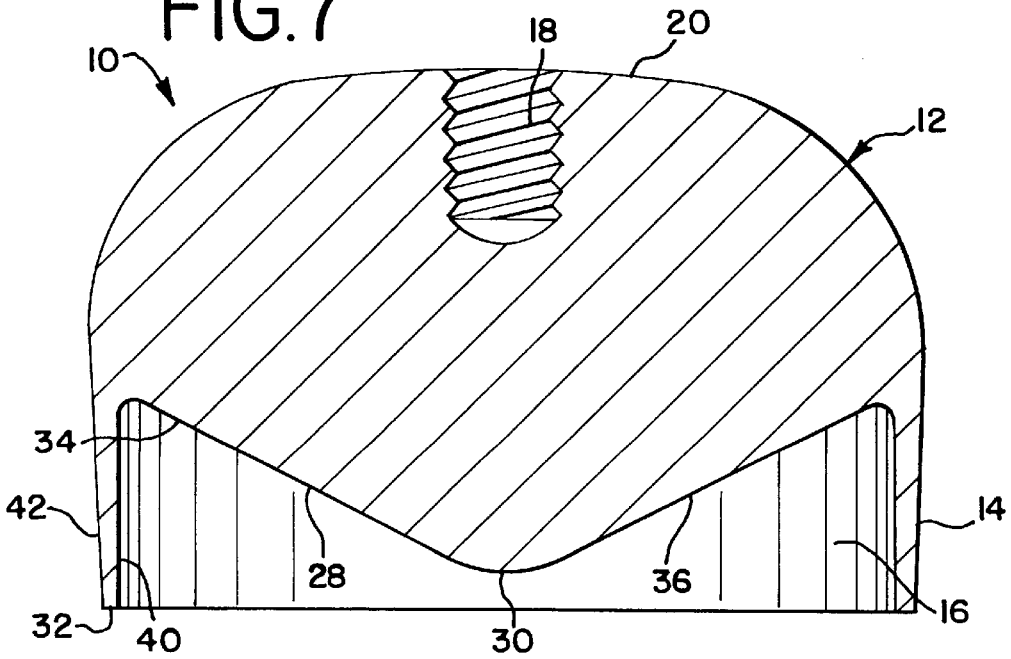
FIG. 7 is a cross sectional front side view of the manual refuse compactor of FIG. 1 with threading for attaching a broom handle.

Referring now to FIGS. 3, 4, 6 and 7, the body 12 has a connector 18. Preferably, the connector 18 is on the top 20 of the body 12. The connector 18 allows the attachment of a handle 22, such as a broom stick. The handle 22 may comprise wood or fiberglass with or without a threaded metal or plastic end piece. Preferably, the connector 18 is a threaded hole for receiving a broom stick as shown in FIG. 7. The threading is preferably angled, as known in the art, to more securely hold the handle 22 to the connector 18. Other connectors could be used, such as a bolt or cotter pin connection. Further, the connector 18 could comprise a handle molded as part of the body 12.

Figure 8:
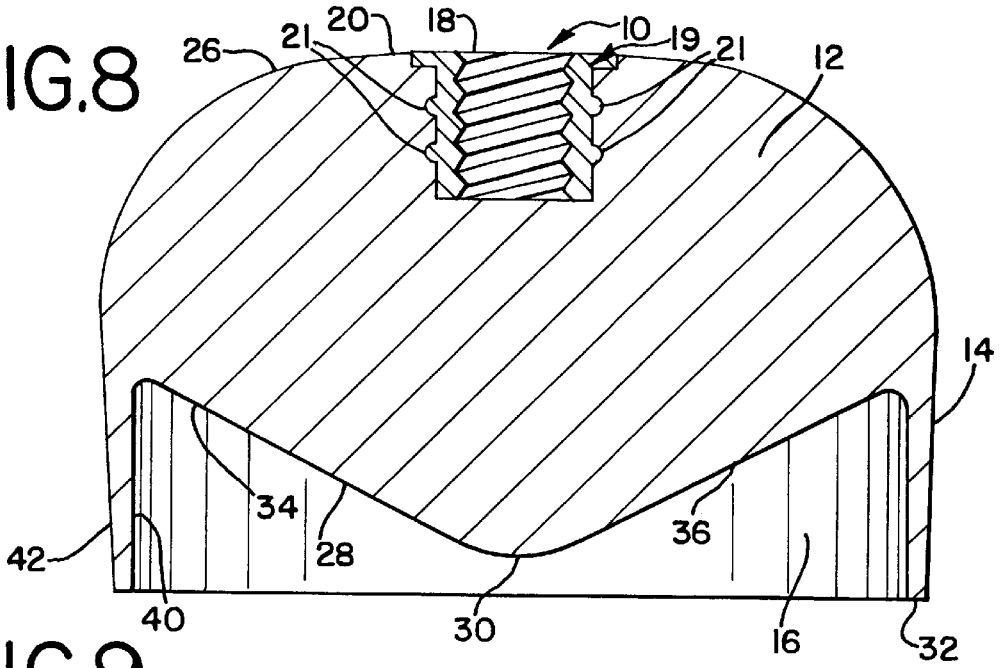
FIG. 8 is a cross sectional front side view of the manual refuse compactor of FIG. 1 with an insert.
Figure 9:
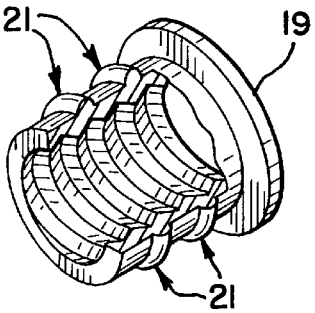
FIG. 9 is a perspective view of an insert for use with the manual refuse compactor of FIG. 1 with a cutout exposing the threaded interior.

Referring to FIGS. 8 and 9, alternatively, the connector 18 comprises an insert 19. The insert 19 is made from metal, but other materials may be used. The insert 19 has a threaded interior. Ribs 21 are placed on the outside of insert 19. The insert 19 is placed in a hole in the body 12. A broom handle is attached to the threaded interior of the insert 19. Further, the broom handle may have a threaded metal cap for connection with insert 19.

Figure 2:
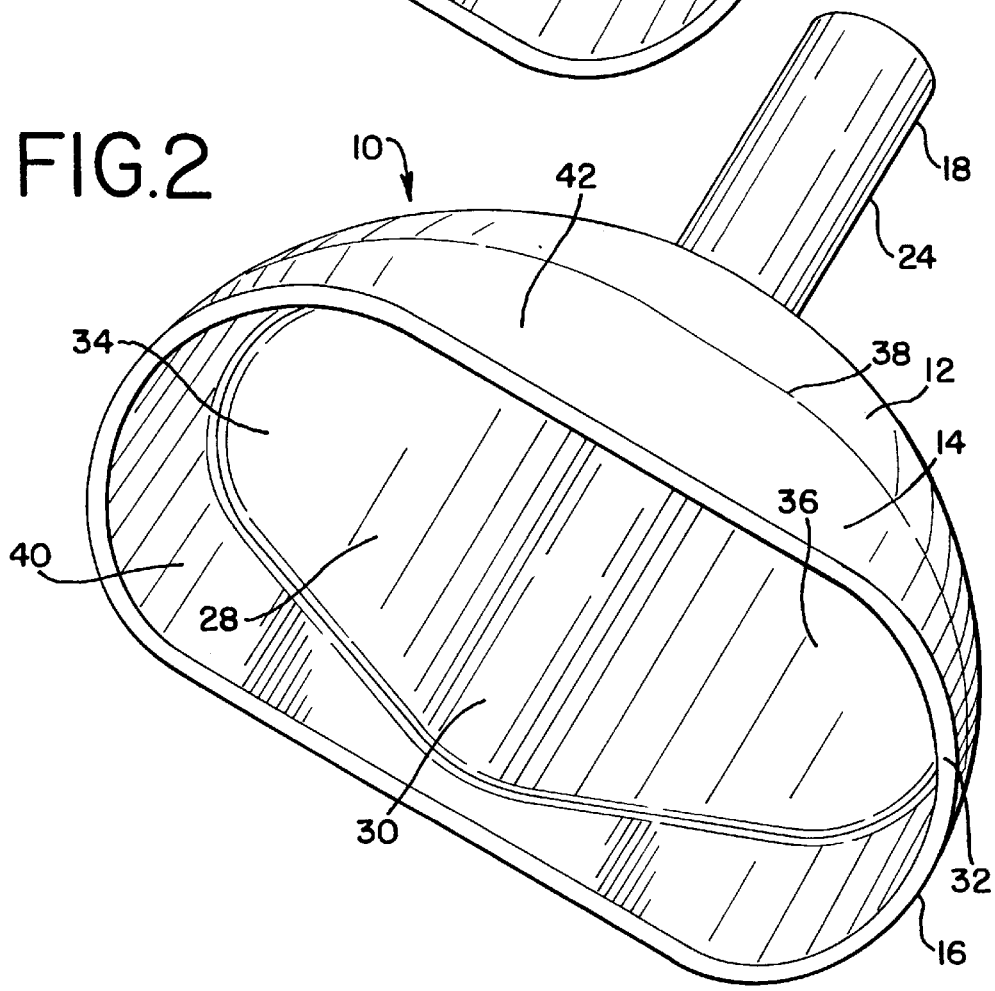
FIG. 2 is a perspective view of a manual refuse compactor with an extension for a handle.

Referring to FIG. 2, another alternative body 12 and connector 18 is provided. A connection extension 24 is provided. The connector 18 is on the connection extension 24. The connection extension 24 may be connected to body 12 by any means and is preferably molded as one piece with body 12.

Referring back to FIGS. 3 and 4, the body 12 preferably has sloped or radiused transition from the top 20 to the sides. Sloped edges or radius 26 on the top 20 provide the transition. The radius 26 is outward from the connector 18. The radius 26 allows waste to fall from the compactor 10 and avoids collecting the waste on the top 20 of body 12.

Referring to FIGS. 1 and 3, the cavity 16 is shown. The cavity 16 is created by the extension of lip 14 from the body 12. Lip 14 surrounds cavity 16. Alternatively, lip 14 may have gaps or an open end, so that lip 14 only partially surrounds the cavity 16. Also, lip 14 may comprise several separate lips at least partially surrounding respective cavities. The bottom 28 of body 12 further defines the cavity 16.

The bottom 28 generally comprises a first half 34 and a second half 36. Bottom 28 may be of any surface texture. Preferably, the first and second halves 34, 36 have a smooth surface texture and are flat. First and second halves 34, 36 join at the crown 30. Thus, the bottom 28 has a v-shaped surface as shown in FIGS. 3 and 7. The v-shaped surface does not have any holes into which waste may get trapped.

Alternatively, bottom 28 may have other surface shapes. Thus, crown 30 may be formed by other extending structures. For example, several conical protrusions or multiple v-shaped protrusions could be formed on bottom 28.

Preferably, the crown 30 extends from bottom 28 away from body 12 and towards lip edge 32. The crown 30 does not extend to lip edge 32.

The v-shaped surface prevents waste from getting trapped within the cavity 16. The crown 30 acts to bend or break waste and helps prevents suction in the cavity 16 as the compactor 10 is lifted away from the compacted refuse. Any waste trapped in cavity 16 is easily removed by hand. The bottom 28 pushes the debris downward to pack the debris firmly. Alternatively or additionally, holes through body 12 could be provided to reduce suction, but such holes may trap debris.

Figure 5:
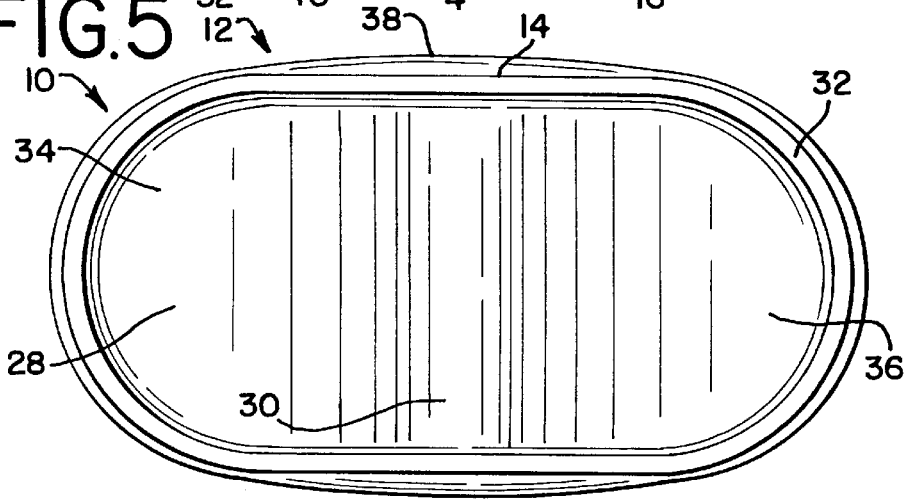
FIG. 5 is a bottom view of the manual refuse compactor of FIG. 1.

Referring to FIG. 5, the circumference 38 of bottom 28 and body 12 have an oval shape or a rectangular shape with rounded corners. Other shapes may be used. Preferably, the circumference 38 is rounded. Any corners may act to damage or rip the waste container as the compactor 10 is used.

Lip 14 extends from the bottom 28 generally at the circumference 38. The lip 14 may extend from the bottom 28 at different points, such as further inward from circumference 38. Thus, lip 14 is rounded to avoid damaging or ripping the waste container. Referring to FIGS. 3 and 4, lip 14 and body 12 join and form a continuous slightly curved surface. The curved surface has a smooth texture to avoid catching on debris. The curve of the surface avoids damaging or ripping the waste container.

The lip 14 has an inner side 40, an outer side 42 and the lip edge 32. As noted above, the outer side 42 joins body 12 to form the curved surface. Preferably, there is not a jagged edge or protrusion at the junction. The inner side 40 is generally parallel to the outer side 42. The inner side 40 also has a smooth surface texture. The inner side 40 is preferably flat and smooth so that debris does not get caught on the inner side 40. Other surface textures could be used.

Lip edge 32 joins the inner side 40 and the outer side 42. Preferably, lip edge 32 is one tenth (1/10) to one half (1/2) inch wide. The thickness adds structural support to the lip 14 for compacting or breaking waste such as sticks or other less malleable debris. The lip edge 32 breaks or bends debris to better compact the debris. Preferably, lip edge 32 is rounded at the junction with outer side 42. Such rounding avoids damage to the waste container as the compactor 10 is used. Lip edge 32 may also be rounded at the junction with inner side 40, but is preferably angular to better break or even cut debris.

Alternatively, inner side 40 and outer side 42 may join at a point, without lip edge 32. The point junction would act to cut the debris, but may be more prone to damage from the debris. If compactor 10 is made from metal or other more durable material, a cutting edge may be preferable but may cause damage to the waste container.

To use the compactor 10, handle 22, as shown in FIG. 6, is attached to the body 12. Alternatively, handle 22 may be molded or otherwise already attached to body 12. Preferably, handle 22 is a broom handle with threading and is threaded into body 12.

The waste to be compacted, such as household waste or yard waste, is placed in the container. For example, leaves may be placed in a paper yard waste bag. The user grabs handle 22 and inserts the compactor 10 into the container or just above the container. The compactor 10 is pushed downward to compact the debris in the container. Preferably, the compactor 10 is raised and then pushed down multiple times. Each time the compactor 10 is lowered, a different location in the container should be compacted. These steps are repeated and result in compacted debris.

The weight of compactor 10, in conjunction with the pushing, acts to compact the debris. Thus, the waste is compacted firmly. More waste may then be placed into the container for compacting.

Figure 10A:
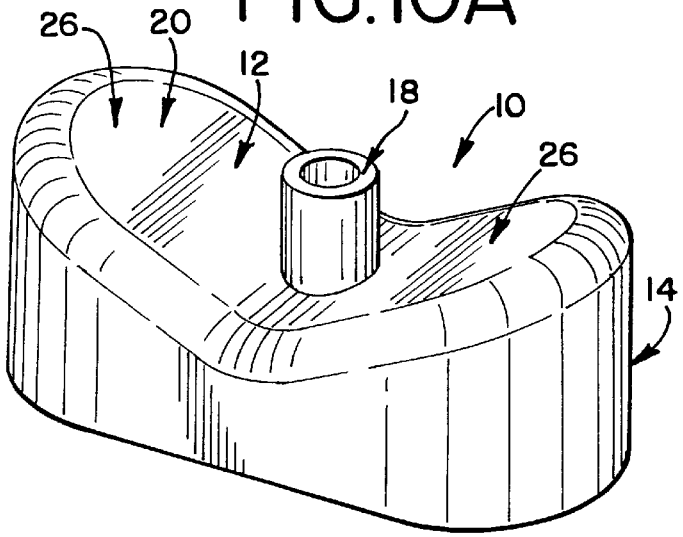
FIG. 10A is a side elevation view of a manual refuse compactor.
Figure 10B:
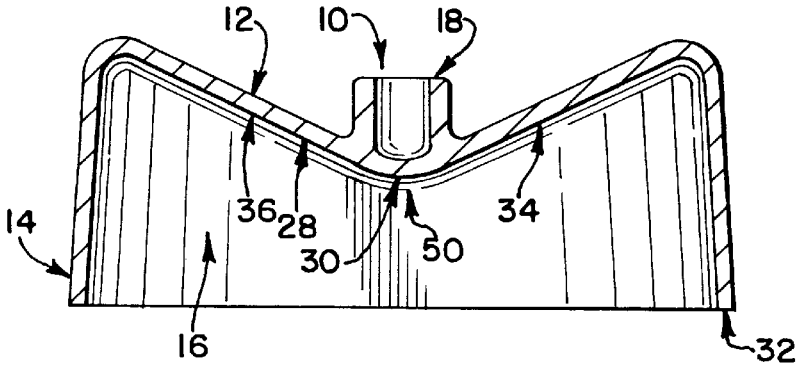
FIG. 10B is a bottom-front-right perspective view of the manual refuse compactor of FIG. 10A.

Referring to FIGS. 10A and 10B, an alternative manual refuse compactor is generally shown at 10 (the same reference numbers as used in FIGS. 1–9 are used where appropriate). This alternative manual refuse compactor 10 incorporates many of the inventive aspects of the embodiments described above. Preferably, the alternative manual refuse compactor 10 is used for yard related refuse.

The manual refuse compactor 10 includes the lip 14, the cavity 16 and the body 12. The lip 14 surrounds the cavity 16, but other lip 14 structures may be used as discussed above. The bottom 28 of the body 12 further defines the cavity 16.

The bottom 28 comprises the v-shaped surface formed by the first and second halves 34 and 36 joining in the crown 30. The bottom 28 and the inner side 40 of the lip 14 preferably have a smooth surface texture.

Unlike the embodiments of FIGS. 1–9, the body 12 has a thickness similar, such as substantially the same, to the width of the lip edge 32 (the lip 14 has a similar thickness as the body 12). Thus, the top 20 conforms to the v-shaped bottom 28. The sloped edges 26 of this embodiment slope downwards towards the connector 18. For molding purposes, an aperture 50 extends from the bottom 28, preferably at the crown 30, to the top 12, preferably at the center of the connector 18. More or no apertures 50 may be used.

Figure 11A:
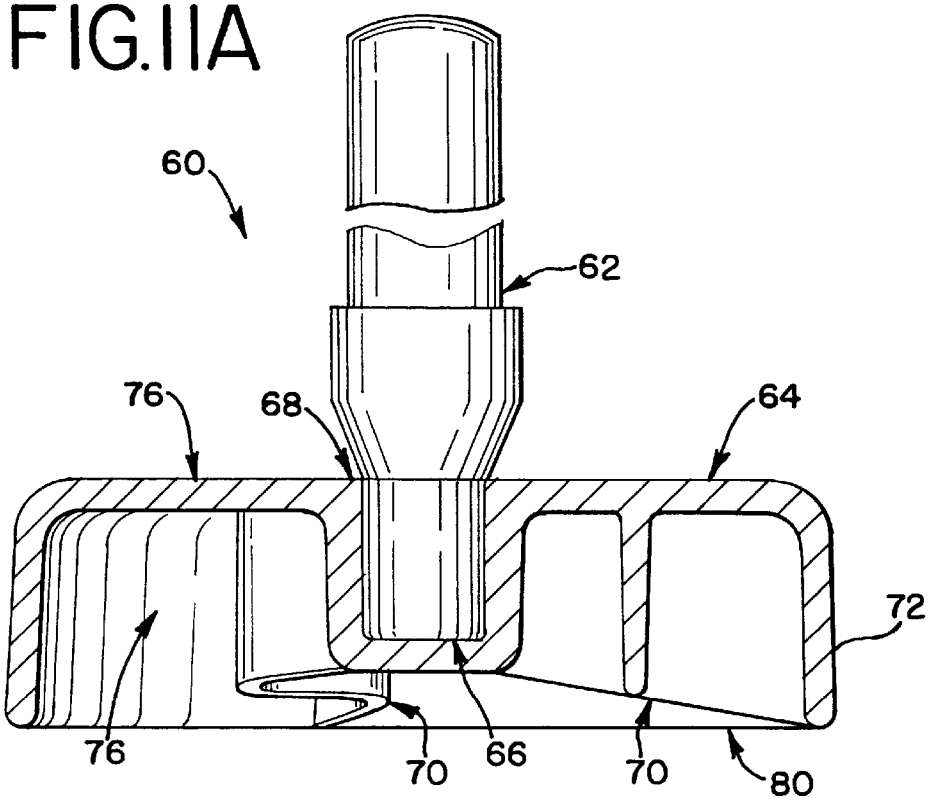
FIG. 11A is a side elevation view of a manual refuse compactor.
Figure 11B:
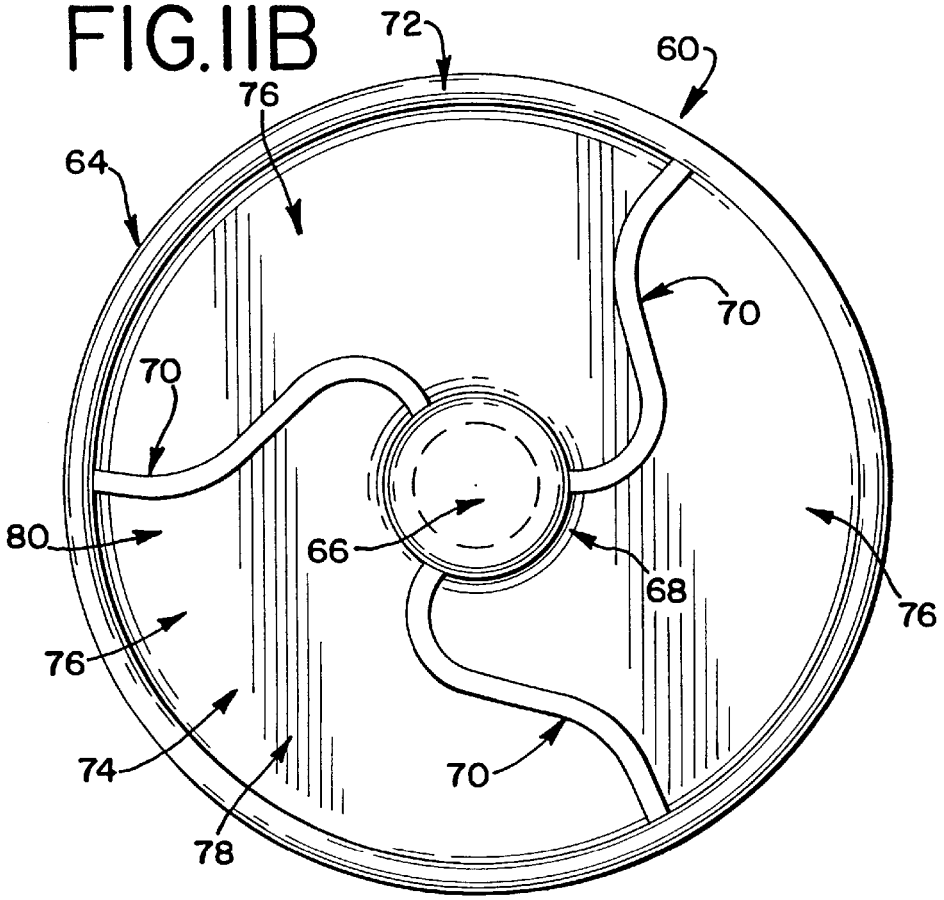
FIG. 11B is a bottom elevation view of the manual refuse compactor of FIG. 11A.

Referring to FIGS. 11A and 11B, an alternative manual refuse compactor is generally shown at 60. This manual refuse compactor 60 is preferably used for household refuse, such as typical kitchen refuse.

The refuse compactor 60 includes a handle 62 and a body 64. The handle 62 is constructed of wood, fiberglass or other materials. The handle 62 preferably has a diameter allowing a comfortable grip by the user, such as similar to a broom stick. Preferably, the handle 62 is about 3 feet long for convenient storage and use. Other diameter and lengths may be used. Other handle designs, such as a U-shaped handle or a molded grip handle, may be used.

The handle 62 includes a threaded end 66. The threaded end 66 is formed on one end of the handle 62. For example, the threads are cut on a wood handle, or a metal or plastic threaded cover is placed on a wood or fiberglass handle. The threads of the threaded end 66 are preferably broomstick threads, but other threading may be used. The threaded end 66 is used to connect the handle 62 to the body 64.

The body 64 is preferably injection molded plastic. Alternatively, suitable metals, such as aluminum, may be milled, lathed and tapped to form the body 64. Additionally, a scent, such as lemon, is added to the plastic.

The body 64 includes connector 68, fins 70, lip 72, and plate 74. The plate 74, and the body 64, preferably has a circular circumference, such as corresponding to about a 5 to 6 inch diameter circle. Other shapes and dimensions may be used.

The lip 72 extends from the bottom 78 of the plate 74 and is preferably molded as one piece with the plate 74. The lip 72 preferably extends from along the entire circumference of the plate 74, but may extend from other portions of the plate 74. The lip 72 may also comprise several separate structures with one or more gaps. Preferably, the lip 72 extends (height) approximately 1 to 2 inches from the plate 74, but other dimensions are possible. The lip 72 extends at a perpendicular angle to the plate 74, but may extend at other angles.

The fins 70 extend from the bottom 78 of the plate 74 and are preferably molded as one piece with the plate 74. The fins 70 preferably also connect with the lip 72 and connector 68. Preferably, there are three fins 70, but more or fewer fins may be used. The height of the fins 70 preferably is substantially the same as the height of the lip 72, but different dimensional relationships may be used. The fins 70 preferably extend at perpendicular angles to the plate 74, but may extend at other angles.

The fins 70 radiate outward from the connector 68. Preferably, the fins 70 curve gradually, all in the same direction, as shown in FIG. 11B. For example, the curves are all generally convex or concave depending on the direction of examination (clockwise or counter clockwise). Near the lip 72, the direction of the curve reverses so that the fins 70 connect to the lip 72 at an approximately perpendicular angle. Thus, refuse may not be as likely to get caught between the fins 70 and the lip 72. Other fin 70 configurations may be used, such as a straight fin or fins and one or more fins different than one or more other fins.

The fins 70, lip 72 and plate 74 are preferably the same thickness, but each may have other dimensions. The outer diameter of the connector 68, the fins 70, the plate 74 and the lip 72 define a plurality of cavities 76. Thus, the interior of the cavities 76 are open at the bottom 80 of the body 64.

The connector 68 is preferably molded as one piece with the plate 74 at the center of the plate 74. The connector 68 extends from the bottom 78 of the plate 74 substantially the same distance as the fins 70 and lip 72, but other heights may be used. The connector 68 is hollow, so that an aperture passing through the body 64 is created. The inner diameter of the connector 68 is threaded to receive the threaded end 68 of the handle 62. Thus, the connector 68 joins the body 64 to the handle 62. Preferably, the threading is angled, as known in the art, to more securely hold the handle 62 to the connector 68. Other connections may be used, such as the handle 62 and body 64 molded as one piece.

Additional accessories may be provided with the compactor 60. For example, a topper may be glued to the top of the handle 62. The topper would preferably comprise a plastic piece molded in a shape corresponding to the scented plastic body 64. For example, a molded lemon is glued to the top of the handle. Furthermore, a tray may be provided for holding the compactor 60. For example, the tray comprises a plate corresponding to and slightly larger than the plate 64. Lips are provided on the tray. Thus, the compactor 60 is placed within the tray, and the tray prevents any refuse from contacting other surfaces.

A wide range of changes and modifications can be made to the preferred embodiment described above. For example, various handles 22 or connectors 18 could be used instead of a broom handle and threading. Thus, it is the following claims, including all equivalents, which are intended to define the scope of this invention.

I claim:

1. An apparatus for manually compacting refuse, said apparatus comprising:

a) a body comprising:

i) a bottom surface comprising a center region and a circumference region;

ii) a plurality of fins extending from the center region to the circumference region;

iii) a lip extending at a perpendicular angle from the bottom surface, the lip extending a first distance from the circumference region;

iv) a center section extending a second distance from the center region, the second distance being less than the first distance, wherein each of the plurality of fins extend the first distance from the bottom surface adjacent the lip and extend the second distance from the bottom surface adjacent the center section;

v) the bottom surface, fins and lip defining a plurality of cavities open downward; and b) a handle on a top surface of the body.

2. The apparatus of claim 1 wherein the bottom surface and the top surface correspond to a plate.

3. The apparatus of claim 1 wherein the lip and fins extend from the bottom surface a substantially same distance adjacent the circumference region.

4. The apparatus of claim 1 wherein the fins curve gradually.

5. The apparatus of claim 4 wherein each of the fins has the same curve.

6. The apparatus of claim 4 wherein the fins connect to the lip at substantially perpendicular angles.

7. The apparatus of claim 1 wherein the body further comprises a connector.

8. The apparatus of claim 7 wherein the connector extends from the bottom surface and comprises a threaded aperture.

9. The apparatus of claim 8 wherein:

c) the handle comprises a threaded end; and d) the threaded end mates with the threaded aperture.

10. An apparatus for manually compacting refuse, said apparatus comprising:

a) a body comprising:

i) a plurality of gradually curved fins radiating from a center region to a circumference region, each of the plurality of fins curving in the same direction;

ii) a lip extending from the circumference region; and b) a handle on a top surface of the body.

11. The apparatus of claim 10 wherein the fins are concave with reverse curves on the ends adjacent the lip.

12. The apparatus of claim 10 wherein:

c) the body comprises a plate;

d) the lip and fins extend from a bottom of the plate to define a plurality of cavities.

* * * * *